US009470397B2

(12) United States Patent
Gadegaard et al.

(10) Patent No.: US 9,470,397 B2
(45) Date of Patent: Oct. 18, 2016

(54) LIGHT COLLECTING SYSTEM WITH A NUMBER OF REFLECTOR PAIRS

(71) Applicant: MARTIN PROFESSIONAL A/S, Aarhus N (DK)

(72) Inventors: Jesper Gadegaard, Tilst (DK); Thoger Jensen, Aalborg (DK)

(73) Assignee: MARTIN PROFESSIONAL APS, Aarhus (DK)

( * ) Notice: Subject to any disclaimer, the term of this patent is extended or adjusted under 35 U.S.C. 154(b) by 0 days.

(21) Appl. No.: 14/365,062

(22) PCT Filed: Dec. 20, 2012

(86) PCT No.: PCT/DK2012/050487

§ 371 (c)(1),
(2) Date: Jun. 12, 2014

(87) PCT Pub. No.: WO2013/091654

PCT Pub. Date: Jun. 27, 2013

(65) Prior Publication Data

US 2014/0328060 A1 Nov. 6, 2014

(30) Foreign Application Priority Data

Dec. 21, 2011 (DK) ..... 2011 70744

(51) Int. Cl.
*F21V 7/00* (2006.01)
*F21V 7/09* (2006.01)
(Continued)

(52) U.S. Cl.
CPC ..... *F21V 7/0066* (2013.01); *F21V 7/0016* (2013.01); *F21V 7/0058* (2013.01);
(Continued)

(58) Field of Classification Search
CPC .. F21V 7/0066; F21V 7/0016; F21V 7/0058; F21V 7/09
See application file for complete search history.

(56) References Cited

U.S. PATENT DOCUMENTS

2011/0292654 A1 12/2011 Haerle

FOREIGN PATENT DOCUMENTS

CN 1662772 A 8/2005
DE 20 2008 014786 U1 2/2009
(Continued)

OTHER PUBLICATIONS

International Search Report for PCT/DK2012/050487, dated May 3, 2013.
(Continued)

*Primary Examiner* — Joseph L Williams
(74) *Attorney, Agent, or Firm* — Artegis Law Group, LLP

(57) ABSTRACT

The present invention relates to a light collector for an illumination device collecting light from a plurality of light sources and combing the collected light into a common light beam, where the common light beam is coupled through an optical gate. The light sources are distributed offset and around an optical axis and the light beam collector comprises a first reflector surrounding the optical axis and a second reflector surrounding the optical axis, where the first reflector reflects the sources light beams towards the second reflector and where the second reflector reflects the source light beams in a direction along the optical axis. The light beam collectors is divided into a number of reflector pairs, where each reflector pair comprises a first surface part of the first reflector and a second surface part of the second reflector, where the second surface part receives light from the corresponding first surface part of the reflector pair.

21 Claims, 8 Drawing Sheets

(51) Int. Cl.

| | |
|---|---|
| *F21S 10/00* | (2006.01) |
| *F21V 5/00* | (2015.01) |
| *F21V 5/04* | (2006.01) |
| *F21V 13/04* | (2006.01) |
| *F21W 131/406* | (2006.01) |
| *F21Y 101/02* | (2006.01) |
| *F21Y 105/00* | (2016.01) |
| *F21Y 113/02* | (2006.01) |

(52) U.S. Cl.

CPC ..... *F21V 7/09* (2013.01); *F21S 10/007* (2013.01); *F21V 5/008* (2013.01); *F21V 5/048* (2013.01); *F21V 13/04* (2013.01); *F21W 2131/406* (2013.01); *F21Y 2101/02* (2013.01); *F21Y 2101/025* (2013.01); *F21Y 2105/008* (2013.01); *F21Y 2113/02* (2013.01)

(56) References Cited

FOREIGN PATENT DOCUMENTS

| | | | |
|---|---|---|---|
| DE | 10 2007 049345 | A1 | 5/2009 |
| EP | 0 978 748 | A1 | 2/2000 |
| EP | 1607677 | A1 | 12/2005 |
| GB | 2457296 | A | 8/2009 |
| JP | 2011181713 | A | 9/2011 |
| WO | 2006027621 | A2 | 3/2006 |
| WO | 2008047851 | A1 | 4/2008 |
| WO | 2010005472 | A2 | 1/2010 |
| WO | 2011006501 | A1 | 1/2011 |

OTHER PUBLICATIONS

European Search Report for EP 12 86 0132 mailed on Jul. 20, 2015.

LIGHT COLLECTING SYSTEM WITH A NUMBER OF REFLECTOR PAIRS

CROSS-REFERENCE TO RELATED APPLICATIONS

The present application is a national stage application of the international application titled, "LIGHT COLLECTING SYSTEM WITH A NUMBER OF REFLECTOR PAIRS," filed on Dec. 20, 2012, and having application number PCT/DK2014/050487. This international application claims priority to Danish patent application titled, "LIGHT COLLECTING SYSTEM FOR ILLUMINATION DEVICE", filed on Dec. 21, 2011, and having application number PA 2011 70744. The subject matter of these related applications is hereby incorporated herein by reference.

FIELD OF THE INVENTION

The present invention relates to a light collector for an illumination device collecting light from a plurality of light sources and combing the collected light into a common light beam, and where the common light beam is concentrated through an optical gate.

BACKGROUND OF THE INVENTION

In order to create various light effects and mood lighting in connection with concerts, live shows, TV shows, sport events or as a part on architectural installation, light fixtures creating various effects are getting more and more used in the entertainment industry. Typically entertainment light fixtures create a light beam having a beam width and a divergence and can for instance be wash/flood fixtures creating a relatively wide light beam with a uniform light distribution or it can be profile fixtures adapted to project image onto a target surface.

Light emitting diodes (LED) are, due to their relatively low energy consumption, high efficiency, long lifetime, and capability of electronic dimming, becoming more and more used in connection with lighting applications. LEDs are used in lighting applications for general illumination such as wash/flood lights illuminating a wide area or for generating wide light beams e.g. for the entertainment industry and/or architectural installations. For instance like in products like MAC101™, MAC301™, MAC401™, MAC Aura™, Stagebar2™, Easypix™, Extube™, Tripix™, Exterior 400™ series provided by the applicant, Martin Professional A/S. Further LEDs are also being integrated into projecting systems where an image is created and projected towards a target surface, for instance like in the products MAC 350 Entour™ or Exterior 400 Image Projector™ also provided by the applicant, Martin Professional A/S.

Typically illumination devices based on LEDs comprises a multiple number of LEDs in order to achieve a high light output. In general it is desired to have illumination devices capable of illuminating very bright light beams and which at the same time is very energy efficient meaning that the light output pr. consumed power unit (e.g. measured as lumen pr. Watt) is as high as possible. However this is hard to achieve in projecting systems where the light in general is collected through an optical gate, which is imaged onto a target surface using an imaging optical system. Several attempts to achieve an effective LED based projecting device have been attempted, however further improvements in light output and efficiency is always desired.

WO0198706, U.S. Pat. Nos. 6,227,669 and 6,402,347 disclose lighting systems comprising a number of LEDs arranged in a plane array where a converging lens is positioned in front of the LED in order to focus the light, for instance to illuminate a predetermined area/gate or for coupling the light from the diodes into an optical fiber.

U.S. Pat. Nos. 5,309,277, 6,227,669, WO0198706, JP2006269182 A2, EP1710493 A2, U.S. Pat. No. 6,443,594 disclose lighting systems where the light from a number of LEDs is directed towards a common focal point or focusing area, for instance by tilting the LEDs in relation to the optical axis (JP2006269182 A2, WO0198706, U.S. Pat. No. 5,309,277) or by using individually refracting means positioned in front of each LED (U.S. Pat. Nos. 6,443,594, 7,226,185B, EP1710493).

WO06023180 discloses a projecting system comprising a LED array with a multiple number of LEDs where the light from the LEDs are directed towards a target area. The LEDs may be mounted to a surface of a curved base as or to a surface of a plane base.

Alternatively to the systems where the light from the light sources are directed directly along the optical axis several attempt have been made to create optical system where the light sources are arranged around the optical axis and where the light is emitted towards the optical axis in a direction substantially perpendicular to the optical axis and where a reflecting object is adapted to receive the light and reflect the light along the optical axis. For instance the following documents show such systems: JP2003347595, EP1466807, U.S. Pat. No. 7,237,927, GB2432653, EP2062295, EP2339224, EP2339225A, U.S. Pat. No. 7,891,840B. Commonly for these documents is the fact that the reflecting object is embodied as a cone or pyramid reflecting light form the light sources where the sides of the cone or pyramid reflect the light along the optical axes. However these systems are not very efficient as there is a relatively high loss of light due the fact that the top part of the light beams will pass the narrow top/tip of the cone or pyramid reflector rather than being reflected alone the optical axis. As a result these systems have a low light output pr. power unit. Further loss occurs when the common light beam is directed to an optical gate and later collected by a projecting system.

EP 0978748 discloses a multiple light source unit including:

- a plurality of light sources for emitting light beams;
- a condensing lens,
- a mirror for directing the light beams from the plurality of light sources to the condensing lens; and
- a light guiding element for receiving the condensed light beams through a light receiving section and for emitting the light beams through a light emitting section, wherein the light beams are parallel to an optical axis of the condensing lens whereon the light beams from the plurality of light sources are incident through respective positions on the condensing lens and diffracted into the light receiving section of the light guiding element. The mirror comprises a first mirror and a second mirror where the first mirror reflects the light beams from the light sources in a direction that intersects the optical axis of the condensing lens and the second mirror allows the light beams reflected from the first mirror to be incident into the condensing lens by directing the light beams in a direction parallel to the optical axis of the condensing lens. The first mirror is a conical internal-reflection mirror for reflecting the light beams from the plurality of light sources, and the second mirror is a conical external-reflection mirror for reflecting the light beams from the first mirror. The light guiding element mixes the light beams and reduces their coherence to flatten the light intensity distribution. The light guiding element needs to be long in order to mix the light beams from each source into a common light beam which can be used for projecting devices where the common light beam illuminates an optical gate where a light modulating object is positioned and where a projecting system is designed to image the optical gate and/or modulating object onto a target surface. The light sources are semi-conductor laser devices, producing relatively narrow and parallel light beams and the dimensions of the first and second mirror are much larger than the light beams. As a consequence the laser beams can thus be focused into the light guiding element, as the laser beams will be inside the first and second mirror. However in illumination devices it is desired to use ordinary LEDs which, however, as which due to etendue issues cannot produce as narrow and parallel light beams as laser devices. As a consequence there will be a large loss of light if the laser devices of EP 0978748 were replaced by ordinary LEDs, as a large part of the light reflected by the first reflector will not hit the second reflector due the fact the second reflector narrows down at the top of the cone. This light will not be reflected towards the converting lens by the second reflector. Alternatively EP 0978748 discloses that mirror and the condensing lens can be replaced by a concave mirror. Here, the light guide element is placed in such a manner that its optical axis coincides with the optical axis of the concave mirror and its light-receiving aperture is positioned at a focal point of the concave mirror. The embodiment results in a large light source unit as the concave mirror need to be much larger than the light beams, especially in the case where ordinary LEDs are used since as the light beams from these will be relative broad compared to a laser beam. Yet another issue is the fact that ordinary LED due to the manufacturing process typically are provided with rectangular dies and as a consequence the light guiding element needs to be event longer in order to mix the light beams properly.

U.S. Pat. No. 6,830,359 discloses an illuminating or indicating device, including at least two light sources, each light source being associated with a first optical system where each first optical system, at finite distance, forms a real image of the light source, the images of the light sources being coincident at a common point constituting a secondary source, and a second optical system having an optical axis passing through the secondary source forms an illuminating or indicating beam from this secondary source. In one a variant the first optical systems forming real images of the light sources are portions of ellipsoids arranged in a corolla about the axis optical axis in such a way that their first foci coincide with the light sources and that their second foci are coincident with each other on the optical axis and with the object focus of the reflecting surface of the second optical system. The second optical system is adapted to image the secondary source at infinity from the common point. This illumination device is thus not usable in projecting systems where an image of a light modifier needs to be projected to a projecting surface. The second optical system is a convex reflecting surface carried out as a revolution of a parabolic profile. This revolution is arranged in such a way that its optical axis is coincident with the axis of symmetry with respect to which the light sources are arranged such that its focus is coincident with the secondary source. As a consequence, the light beams from different light sources will constitute different part of the common light beam rather than being mixed.

WO06027621 discloses a light engine for the delivery and reformatting of the output of a light source. The light engine has a light source and a first mirror for reflecting light from the light source towards a target. The first mirror has a first focal point. A polarizer is provided between the first mirror and its focal point. The light engine according may also comprise a second mirror having a second focal point and adapted to reflect light towards the first mirror. The first and second mirrors are hyperbolic, elliptical or parabolic and the shape of the light sources needs to match the shape of the target in order to create an energy efficient system. This is often not possible when using a spherical symmetric optical system, as LEDs, due the manufacturing process, typically are provided polygonal shaped especially rectangular shapes In general the prior art fixtures try to increase the lumen output by adding as many light sources as possible. The consequence is, however, that the efficiency with regard to power consumption versus light output is very low. Furthermore, a large amount of light is lost as the prior art fixtures typically only couple a central part of the light of the light beams through the gate in order to provide a uniform illumination of the gate, which again reduces the efficiency. The available space in light fixtures is often limited and it is difficult to fit many light sources into prior art fixtures, for instance because the optical components associated with the light sources often take up a lot of space. Yet another aspect is the fact that color artifacts often appear in the output from fixtures having light sources of different colors.

DESCRIPTION OF THE INVENTION

The object of the present invention is to solve the above described limitations related to prior art and provide a compact projecting illumination device. This is achieved by an illumination device as described in the independent claims. The dependent claims describe possible embodiments of the present invention. The advantages and benefits of the present invention are described in the detailed description of the invention.

DETAILED DESCRIPTION OF THE INVENTION

The present invention is described in view of an illumination device including a number of LEDs generating a light beam, however the person skilled in the art realizes that the present invention relates to illumination devices using any kind of light source such as discharge lamps, OLEDs, plasma sources, halogen sources, fluorescent light sources, lasers, LED leasers, etc. and/or combinations thereof. It is to be understood that the illustrated embodiments are simplified and illustrate the principles of the present invention rather than showing exact embodiments. The skilled person will thus understand that the present invention can be embodied in many different ways and also comprise further components in addition to the shown components.

Figure 1A:
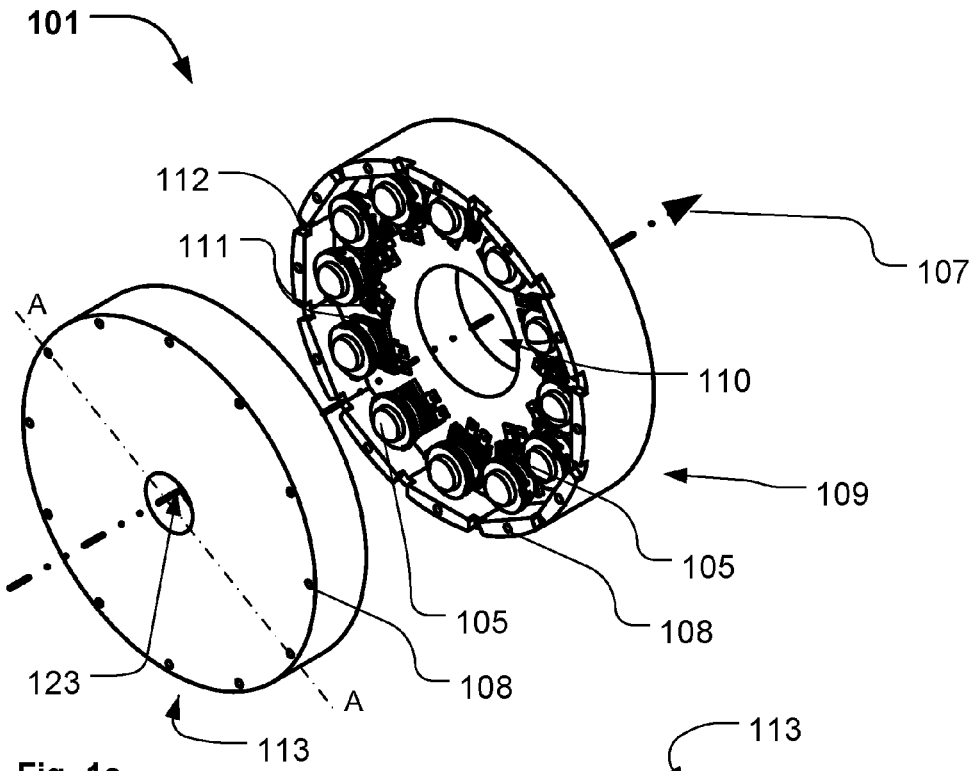
FIG. 1*a*-1*d* illustrate an embodiment of a illumination module according to the present invention.
Figure 1B:
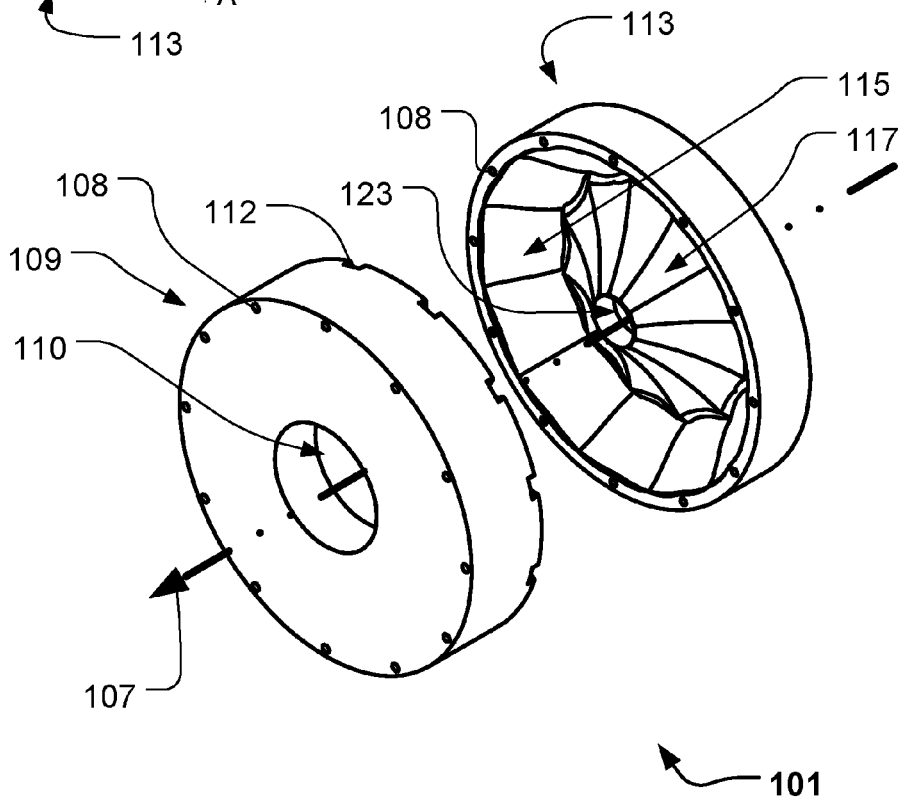
Figure 1C:
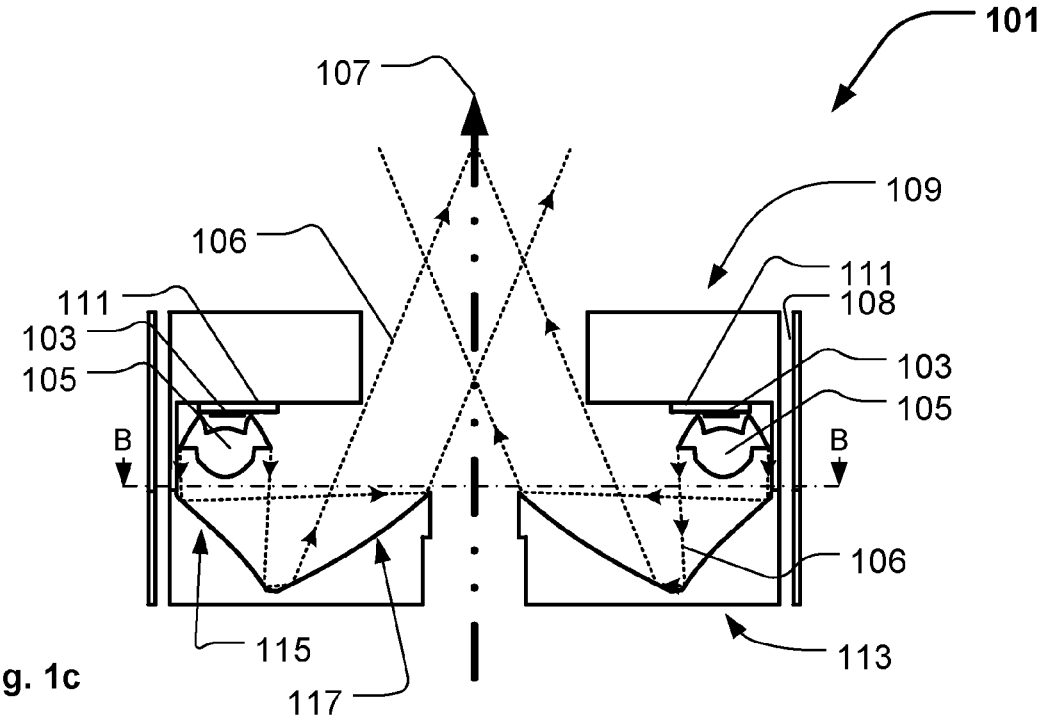
Figure 1D:
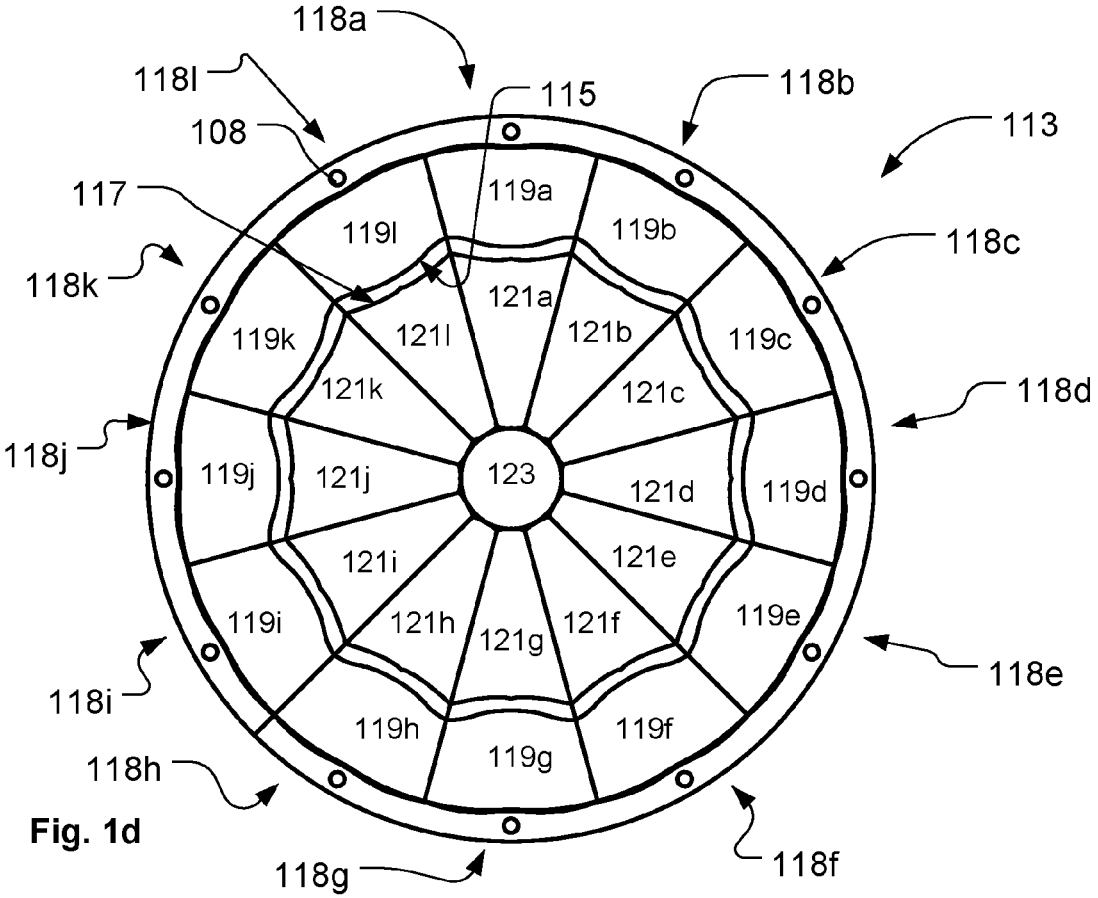

FIG. 1*a*-1*d* illustrate one embodiment of an illumination module 101 according to a first aspect of the present invention. FIGS. 1*a* and 1*b* are perspective exploded views respectively from the bottom and top. FIG. 1*c* is a simplified cross sectional view along line A-A in FIG. 1*a* and FIG. 1*d* is cross sectional view along line B-B of FIG. 1*c* (corresponds to a top view of the light collector 113).

The illumination module 101 comprises a number of light sources 103 and number of light collectors 105, where each light collector 105 is adapted to collect light from one of the light sources 103 and is adapted to convert the collected light into a source light beam (106 illustrated as dotted lines in FIG. 1*c*). The light sources are only visible in FIG. 1*c*, as they are arranged below the light collectors 105. It is to be understood that in alternative embodiments the light collectors may be adapted to collect light form more than one light source, for instance in the case where the light sources are multicolor LEDs with a number of LED dies emitting different color. It is also noted that the light sources and/or light collectors may be different for instance in the case that different types (e.g. have different color or color temperature) are used.

The illumination module 101 comprises a light source module 109 whereon the light sources 103 and light collectors 105 are arranged, and a light beam collector 113 adapted to collect and combine the light source beams as described below. The light source module 109 and light collector 113 are fastened together using a number of holes 108 in perimeter thereof using a number of screws (not shown). However the skilled person will be able use other fastening techniques such as glue, clamps, nails, rivets, snap mechanisms, magnets, etc.

The light sources 103 and light collectors 105 are arranged offset an optical axis 107 (dashed-dotted-dotted line), meaning that the light sources and light collectors are positioned a distance from the optical axis 107. In the illustrated embodiment the light sources and light collectors are arranged on a light source module 109 and form a ring around the optical axis 107. The source light beams are emitted and propagates offset the optical axis and in the negative direction of the optical axes. In the illustrated embodiment the light sources are LEDs mounted on a number of PCBs 111 (Printed circuit boards) and the PCB are connected to a power supply (not shown) and control circuits (not shown) as known in the art of lighting. The illumination module comprises a number of holes 112 suitable for wires connecting the PCB to the power supply and control circuits. The illustrated light collectors 105 are embodied as a number of TIR lenses having a central and a peripheral part as known in the art of TIR lenses, however is it to be understood that the light collectors may be embodied as any optical component capable of collecting light form the light source and convert the collected light into a light beam, such as optical lenses, light rods/mixers, reflectors etc. Further the light sources may generate the source light beams directly and the light collectors may in such embodiments be omitted or integrated as a part of the source light beams.

The illumination module comprises a light beam collector 113 adapted to combine the source light beams into a common light beam propagating in the positive direction, along and at the optical axis. The light beam collector comprises a first reflector 115 surrounding the optical axis 107 and a second reflector 117 surrounding the optical axis. The first reflector reflects the sources light beams propagating offset the optical axis towards the second reflector and thereafter the second reflector reflects the source light beams hitting the second reflector in the positive direction along the optical axis. The light beam collector 113 is divided into a number of reflector pairs 118*a*-118*l*, where each reflector pair comprises a first surface part 119*a-l* (only labeled in FIG. 1*d* for simplicity) of the first reflector 115 and a second surface part 121*a-l* (only labeled in FIG. 1*d* for simplicity) of the second reflector 117. The first reflector is thus divided into a number of first surface parts 119*a-l* and the second surface parts is thus divided into a corresponding number of second surface parts 121*a-l* and each of the first and second surface parts have been combined into a reflector pair.

By dividing the first and second reflectors into a number of first and second surfaces parts and arranging the surface parts into reflector pairs makes it possible to optimize the light output of the common light beam and at the same time provide a mixed common light beam providing a uniform light and color distribution. Further the reflector pair makes it possible to concentrate the light source beams at an optical gate along the optical axis. This is achieved as the first surface part (119*a-l*) of each reflector pair can be adapted to concentrate the source light beam onto the second surface part (121*a-l*) whereby most of the light reflected by the first surface part will hit the second surface part and be reflected along the optical axis 107. The first surface part can be further adapted to reshape the shape of the source light beam into a shape similar to the shape of the second surface part where by a larger area of the second surface part is used to reflect the light beam along optical axis. Hereby it is avoided that a part of the light reflected from the first surface part will miss the second surface part. At the same time the second surface can be adapted to form the shape of the common light beam into the desired shaped for instance by forming the common light beam into a circular light beam or any other desired shape. The multiple number of reflector pairs make it further possible to use a number of different light sources where the light source beams are not are identical as each reflector pair can in such situation can be adapted individually in order or maximize the output form each type of light source. For instance in an embodiment using a number of red LEDs, a number of blue LEDs and number of green LEDs the reflector pair of each type of light source can be optimized according the emitting characteristics of the light source and the light collector.

Further by dividing the first and second reflector into first and second surface parts arranged in a number of reflector pairs make it possible to design the first and second surface parts individually and thereby provide them with varying curvature and thereby be adapted according to the light source, light collector, the source light beams and/or the optical gate. For instance in the illustrated embodiment the first surface parts 119*a-l* of the reflector pairs comprise both convex and concave surface parts resulting in the fact that some parts of the light source beam hitting the first surface part will be diverged by the convex surface parts whereas other part will be converted by the concave surface parts.

This can be used to redistribute the light intensity of the source light beam into the desired shape hitting the second surface part. Similar the second surface part comprises also both convex and concave surface parts where the convex surface parts diverge parts of the source light beam and where the concave surface parts converges parts of the source light beams. This can also be used to redistribute the light distribution of the source light beam leaving the second surface part. In other words the convex and concave parts of the first and second surface parts can be mutually designed in order to achieve a desired shape and light distribution of the light source beam and thereby couple more light through the optical gate. For instance the concave and convex surface parts can be designed to eliminate the non-homogenous light distribution of a source light beam coming from a rectangular shaped light source like a LED die or a LED laser emitting a source light beam (laser beam) having a no rotational symmetric emitting profile. For instance the reflector pairs can be adapted to image the light sources at a distance along the optical axis and to distort the image of the light sources at this distance. This makes it possible to provide a mixed and homogenized common light beam, as the distortion of the light source makes it possible to transform the shape of the light source into the desired shape of the common light. For instance in connection with rectangular shaped LEDs it is possible to transform the rectangular image of the LEDs into a more circular spot. This makes it possible to couple the common light beam into an optical gate comprising a light modifier and therefore image the light modifier such as a gobo, a DMD, a DLP, a LCD or the like using a projecting system collecting the light.

In this embodiment and as illustrated in FIG. 1*d* each of the reflector parts are formed as a angular sector, where the second surface parts 121*a-l* are formed in the inner part of the angular sectors and the first surface part 119*a-l* are formed in the outer part of the angular sectors. By shaping the reflector pairs as angular sectors makes it possible to use the entire disc in a setup where the light sources are positioned in a ring around the optical axis.

It is to be understood that the term angular sector may define any shape enclosed by two lines intersecting each other at the optical axis and thus angled in relation each other. The inner boundary of the angular sectors may be constituted by the center of the optical axis or any shape (e.g. arc, straight line, curved line) connecting the two lines at a distance from the center of the optical axis. The outer boundary of the angular sectors can be defined by any shape (e.g. arc, straight line, curved line) connecting the two lines at a distance farther from the optical axis than the inner boundary. The boundary between the first surface part constituting the outer part of the angular sector and the second surface par surface constituting the inner part of the angular sector can be also be formed as any shape connecting the two lines at distance from the optical axis and which lie between the inner boundary and the outer boundary. Further an angular sector can comprise an intermediate part separating the first surface part and the second surface part and the boundaries of the intermediate part can also be defined by any shape connecting the two lines angled in relation to each other.

Figure 2A:
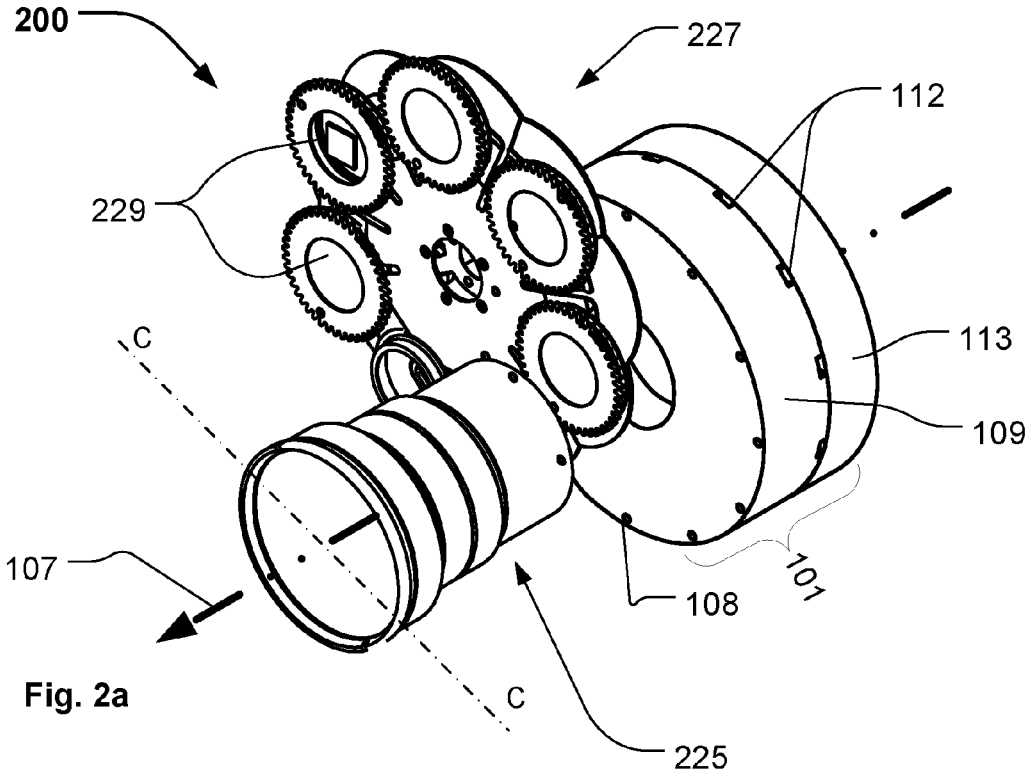
FIGS. 2*a* and 2*b* illustrate an embodiment of an illumination device according to the present invention.
Figure 2B:
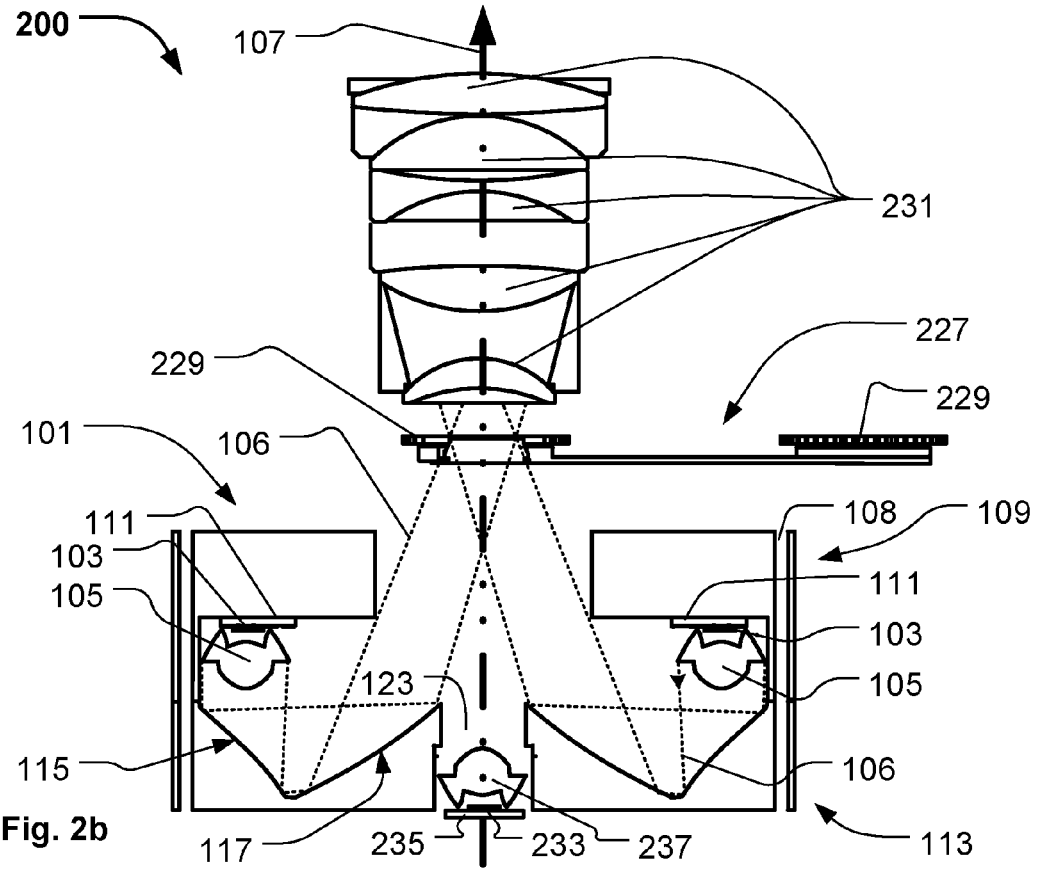
Figure 3A:
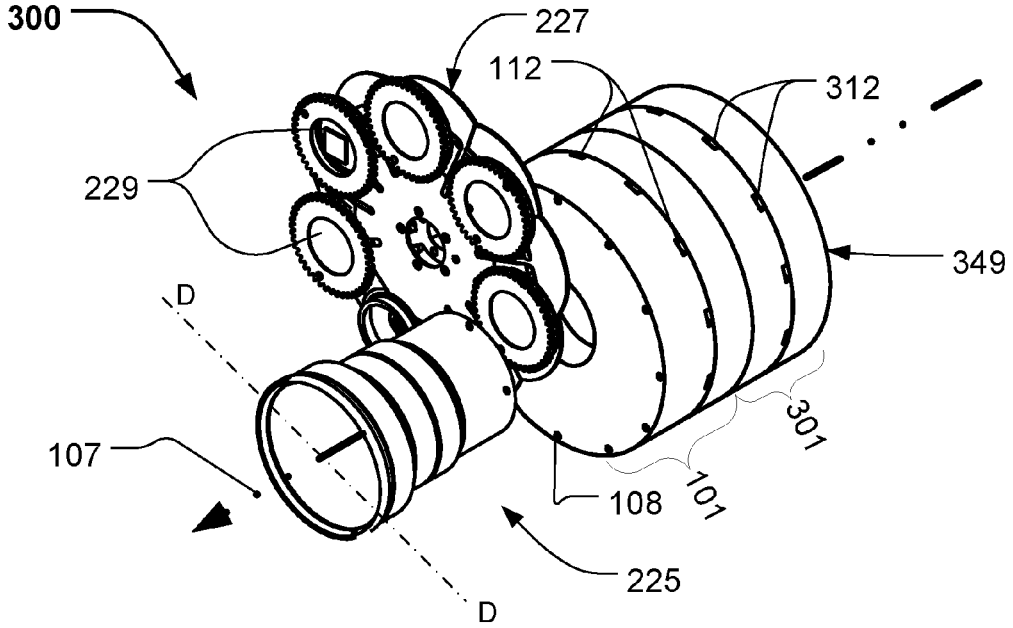
FIGS. 3*a* and 3*b* illustrate an embodiment of an illumination device according to the present invention comprising a first and second illumination module.
Figure 3B:
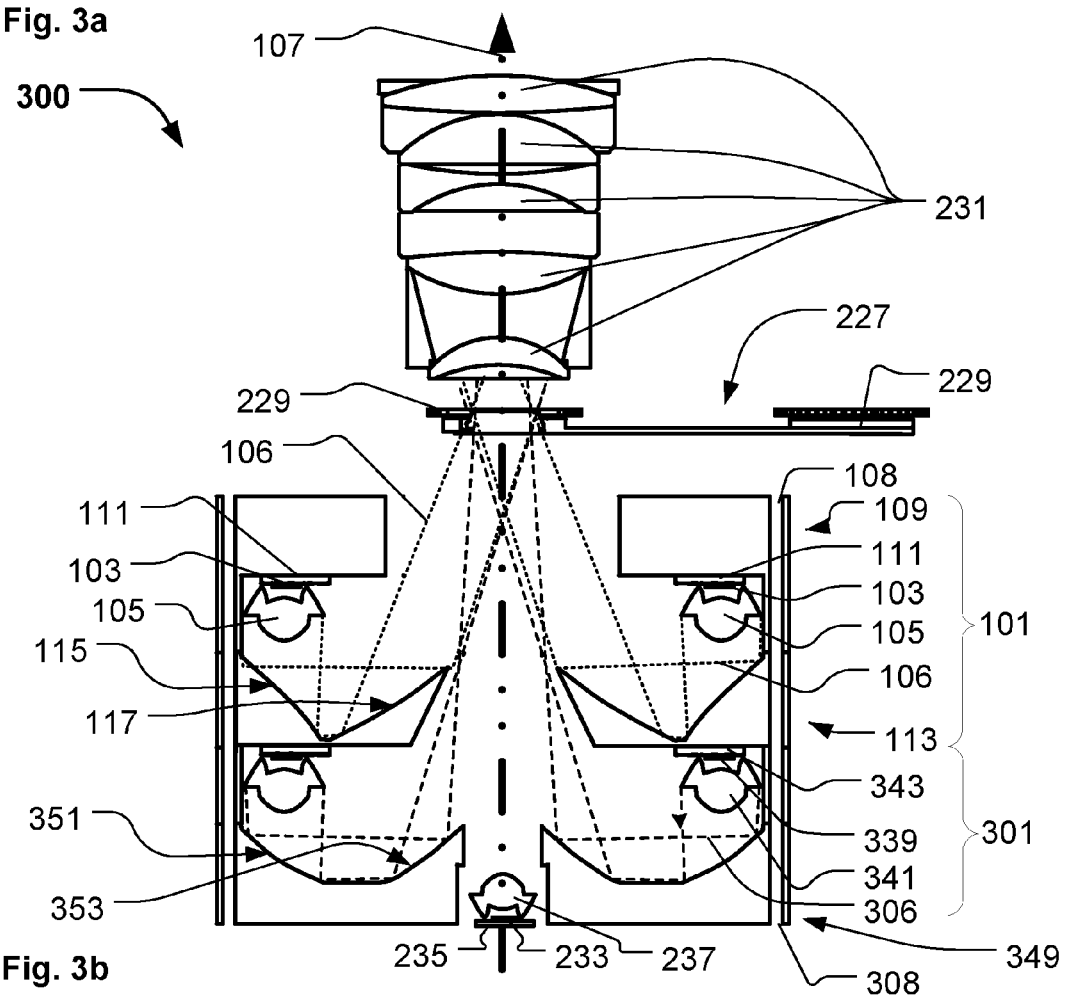

In this embodiment the light beam collector 113 comprises also an aperture 123 arranged at the center and the reflector pairs are positioned around the aperture. The aperture makes it possible to arrange an additional light source at the bottom of the light beam collector which can contribute to the common light beam. This is possible as the second surface parts 121*a-l* can be defined not to include the central part of the light beam collector and the first surface parts 119*a-l* are adapted to reflect a minimum amount of light onto this part. An additional light source can be any kind of light source capable of emitting light along the optical axis and can for instance be a LED as illustrated in FIGS. 2*a* and 2*b* or a second illumination module as illustrated in FIGS. 3*a* and 3*b*.

The mutual size relationship of the different reflector pairs can be used as a design parameter when designing the light collector for instance in order to optimize light output or spectral distribution of the common light beam.

For instance the size of each reflector pair can be defined based on the size of the light sources, the size of the source light beams or the emitting characteristics of the light sources or the source light beams. In this way the mutual size relationship of the different reflector pairs are substantially identical to the mutual relation of the mutual relationship between emitting characteristics of the light sources, the mutual size relationship between the light sources, the mutual relationship between emitting characteristics of the source light beams or the mutual size relationship between the source light beams. This makes it possible to integrate light sources having different size and utilize the light from each light sources in a most effective way. For instance a light source having a large emitting area needs a larger reflector pair compared to a light source having a smaller emitting area in order to collect as much light as possible. The mutual relationship of the size of the reflector pair can thus be determined based on the mutual relationship of the emitting area of the light sources. Alternatively the mutual relationship can be determined based on the mutual relationship of the emitting characteristics of the light sources or the source light beams, as some light sources emits a light into a larger solid angel than other light sources.

Further in an embodiment the mutual size relationship between the different reflector pairs has been determined order to achieve a maximum light output at the optical gate of the illumination device. This can be achieve by designing reflector pairs collecting light form the light sources emitting most light to have a larger size than reflector pairs collecting light from light sources emitting less light, whereby the total light output at the optical gate can be maximized. Similar the mutual size relationship between the different reflector pairs can be determined in order to achieve maximum light output at a target surface whereon an optical projecting system is adapted to image said optical gate.

Further in an embodiment the mutual size relationship between the different reflector pairs has been determined order to achieve a predefined spectra distribution at the optical gate. This can be achieving by designing the mutual size relationship of reflector pairs according the spectral distribution of light emitted by the different light sources. In this way the light collector can be adapted to collect more light from light sources having a certain spectral distribution than light from light sources having another spectral distribution. This can for instance be used design the contributing form different color of light sources in an additive color mixing system (like a RGB system). The mutual size relationship between the reflector pairs can thus be used to design the color gamut or color temperature of the common light beam. Similar the mutual size relationship between the different reflector pairs can be determined in order to achieve predefined spectral distribution at a target surface whereon an optical projecting system is adapted to image said optical gate.

Figure 8A:
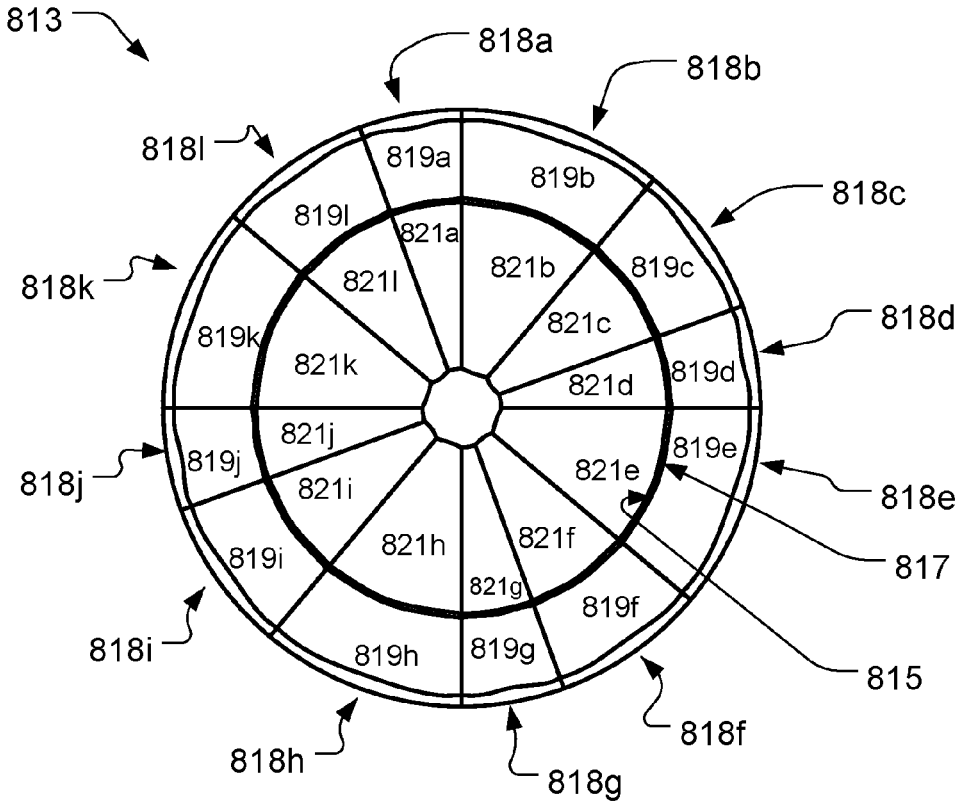
FIGS. 8*a* and 8*b* illustrate a light collector, where the sizes of the reflector pairs are different.
Figure 8B:
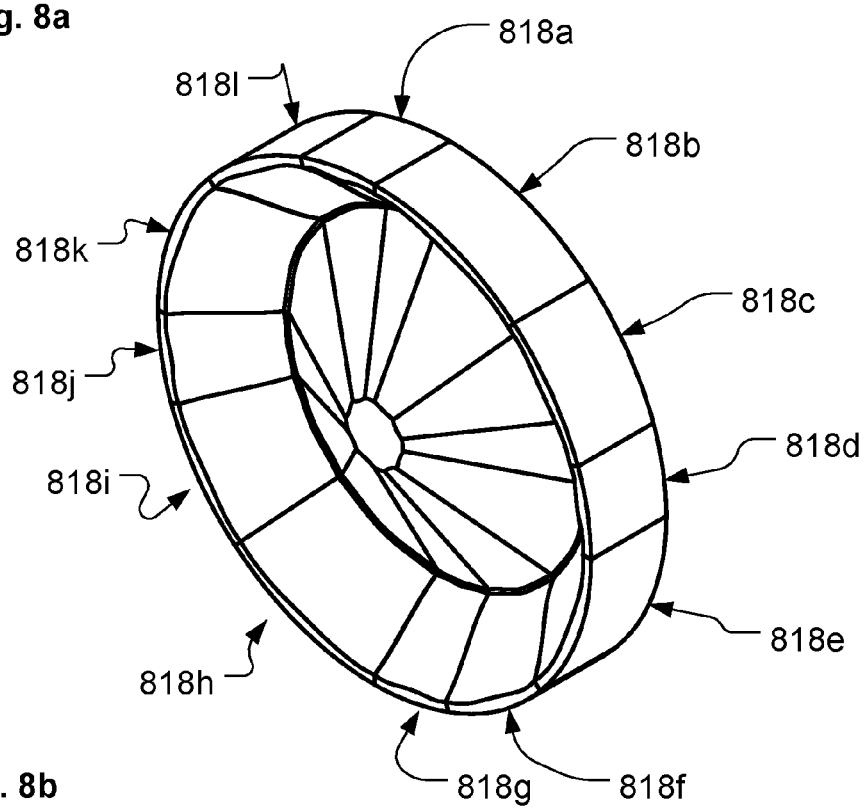

FIGS. 8*a* and 8*b* illustrate a light collector 813 similar to the top view of the light collector 113 shown in FIG. 1*a*-1*d*, where the size of reflector pairs are different. FIG. 8*a* is a top view and FIG. 8*b* I a top perspective view.

As described above the light beam collector 813 is divided into a number of reflector pairs 818*a-l*, where each reflector pair comprises a first surface part 819*a-l* of a first reflector 815 and a second surface part 821*a-l* of a second reflector 817. The first reflector 815 is thus divided into a number of first surface parts 819*a-l* and the second surface parts is thus divided into a corresponding number of second surface parts 821*a-l* and each of the first and second surface parts have been combined into a reflector pair. In this embodiment the mutual size relationship between the reflector pairs have been corresponds to the mutual relationship between the emitting characteristics of the light sources; the mutual size relationship between the light sources; the mutual relationship between emitting characteristics of the source light beams; or the mutual size relationship between the source light beams. Is can be seen that reflector pairs 818*a*, 818*d*, 818*g* and 818*j* have the smallest size and reflector pairs 818*b*, 818*e*, 818*h* and 818*k* have the largest size, while reflector pairs 818*c*, 818*f*, 818*i* and 818*l* have a size between the two other sets of reflectors.

FIG. 2*a*-2*b* illustrates another embodiment of an illumination device 200 according to first and second aspect present invention. FIG. 2*a* illustrates a perspective front view and FIG. 2*b* is a simplified cross sectional view along line C-C in FIG. 2*a*. This illumination device comprises an illumination module 101 similar to the one illustrated in FIG. 1*a*-1*d* and similar elements are labeled with the same reference numbers and will not be described in this section. In this embodiment the illumination device 200 comprises a projecting system 225 and a gobo wheel 227 arranged upstream the optical axis in relation to the illumination module. The projecting system is adapted to collect at least part of the light propagating along the optical axis and project the light along the optical axis. The gobo wheel comprises a number of rotational gobos 229 which can be rotated around a sun gear (not shown) as known in the art of entertainment lighting. The gobos can thus be arranged in the common light beam and act as light forming means. The projecting system 225 comprises a number (seven but can be any number) of optical lenses 231 and is adapted to image the gobo at a distance along the optical axis 107. The illumination module 101 illuminates the gobo with the common light beam which have been optimized to provide a homogeneous light beam and also maximized so that as large a part as possible will be within the acceptance angle of the projecting system 225. It is noticed that the gobo can be replaced with any object capable of forming the light beam such as DMDs, DLPs or LCD. The projecting system can also a comprise zooming means making it possible to change the beam width and/or divergence of the common light beam and can thus acts as a zoom system. Further the projecting system can comprises focusing means capable of focusing the image of the gobos. Each reflector pair of the illumination module 101 can be adapted to provide a homogenized light beam at the optical gate and at the same time provide light beams within the acceptance angle of the projecting system whereby more light will be projected along the optical axis. It is noticed that in some embodiments the gobo wheel can be omitted whereby a non-imaging light beam can be created.

A second aspect of the present invention relates to an illumination device comprising a number of light sources distributed offset and around an optical axis, where the light sources generate a number of source light beams. Further the illumination device comprise a light beam collector adapted to combine the source light beams into a common light beam propagating along the optical axis and through an optical gate, where the light beam collector comprises a first reflector surrounding the optical axis and a second reflector surrounding the optical axis. The first reflector is adapted to reflect said sources light beams towards the second reflector and the second reflector is adapted to reflect the source light beams in a direction along the optical axis. Further the light beam collector comprises an aperture 123 at it center, where the first reflector and the second reflector are positioned around the aperture. An additional light source is adapted to emit light along the optical axis 107 and through the aperture 123 of the light beam collector. This makes it possible to improve the color rendering index of the common light beam as the additional light source can be a light source emitting a broad spectrum of light and the aperture allows all wavelengths to pass through the light beam collector. For instance, as illustrated in FIG. 2*b* an additional LED 233 can be arranged in the aperture 123 of the illumination module. The additional LED is mounted on a PCB 235 and a light collector 237 is adapted to collect light emitted by the LED 233 and converting the collected light into an additional light beam (not shown) propagating along the optical axis. The additional light beam provides further light to the common light beam. In the illuminations device illustrated in FIGS. 2*a* and 2*b*, the light sources 103 are embodied as four red LEDs, four blue LEDs and four green LEDs arranged in an alternating pattern around the optical axis. One quarter of the disc comprises thus one red LED, one green LED and one blue LED and their corresponding reflector pairs are adapted to provide an intense light beam with homogenous color-mixing across the optical gate where the gobos are arranged. The red, green and blue LEDs can be controlled individually as known in the art of intelligent lighting and the color of the common light beam can thus be controlled by regulation the mutual intensity of the red, green and blue LEDs. The additional LED 233 are embodied as a white LED and can thus be used to brighten the common light beam and will also improve the color rendering index (CRI) of the common light beam whereby object illuminated by the common light beam will appear more natural.

In one embodiment off the illumination device at least one of the light sources is a broad spectrum light source emitting a broad spectrum of light and in that at least another of the light sources is a narrow spectrum light source emitting a narrow spectrum of light. A broad spectrum of light of light comprises spectral components distributed over a wavelength interval larger than 200 nm and where a narrow spectrum of light comprises spectral components distributed over a wavelength interval smaller than 200 nm. This improve the color rendering index of the common light beam when a number of narrow spectrum light sources are used, as the broad spectrum light can add missing spectral components to the common light beam.

The skilled person realizes that most light sources may emit light over many wave lengths and it is to be understood that in this patent application the spectral bandwidth of the light is defined as the wavelength interval wherein at least 50% of the emitted power is distributed. Further spectrum bandwidth of the emitted light can be defined as the wavelength interval wherein the relative emitted power of the spectral components is larger than 1/10 of the emitted power spectral component emitting most power. As an example, if the spectral components which have a relative emitted power larger the 1/10 of the emitted power of the most power full spectral component are distributed over a range of 50 nm, then spectral bandwidth will be 50 nm. As another example, if the spectral components which have a relative emitted power larger the 1/10 of the emitted power of the most power full spectral component are distributed over a range of 300 nm then spectral bandwidth will be 300 nm. It is noticed that there might exist spectral components within the bandwidth interval which have a relative emitted power less than 1/10 as it is the distance between the outermost spectral components that defines the spectral bandwidth. This skilled person realizes that the spectral bandwidth can be obtained in other ways for instance as defined by commonly used methods such as, D4σ, 10/90 or 20/80 knife-edge, 1/e2, FWHM, D86.

In one embodiment at least one of the light narrow spectrum light source emits light substantially within only one of the following wavelength intervals:

[380 nm,450 nm] (violet)
[450 nm,495 nm] (blue)
[495 nm,570 nm] (green)
[570 nm,590 nm] (yellow)
[590 nm,620 nm] (orange)
[620 nm,750 nm] (red)

and in that the broad spectrum light source emits light within at least two of the above mentioned wavelength intervals. This makes it possible to combine a number of narrow spectrum light sources which can be used to create a large number of colors based on additive color mixing and at the same time improve the color rendering index as the broad spectrum light source can add further spectral components to the common light beam.

In another embodiment the illumination device comprises:

least one narrow spectrum light source emitting light in the wavelength interval [450 nm,495 nm] (green)
least one narrow spectrum light source emitting light in the wavelength [495 nm,570 nm] (green)
least one narrow spectrum light source emitting light in the wavelength [620 nm,750 nm] (red)

and at least on broad spectrum light source emitting light outside the following wavelength intervals:

[450 nm,495 nm] (blue)
[495 nm,570 nm] (green)
[620 nm,750 nm] (red)

This makes it possible to provide a RGB based illumination device where a large number of colors can be created based on additive color mixing which is widely known. At the same time improve the color rendering index as the broad spectrum light source can add further component to common light beam.

It is noted that, according the second aspect of the present invention, where an additional light sources emits light through an aperture in the light beam collector, the first reflector and second reflector both surrounding the optical can have any shape as long as the is provide an aperture at the center through which an additional light source can emit light. However the first and second reflector of the light collector can also be divided into a number of reflector pairs as according to the first aspect of the invention. For instance the first the shape of the first surface part and the second surface part of the reflector pairs can be designed as described in the example below.

In one embodiment of the illumination device according the second aspect of the present invention, the additional light source is an illumination module comprising a number of additional light sources distributed offset and around the optical axis, where the additional light sources generate a number of additional source light beams. Further the illumination module comprises an additional light beam collector adapted to combine the additional source light beams into a common light beam propagating along the optical axis, where the additional light beam collector comprises a first additional reflector surrounding the optical axis and a second additional reflector surrounding the optical axis. The first additional reflector reflects the additional sources light beams towards the second additional reflector and where the second additional reflector reflects the additional source light beams in a direction along the optical axis. The light emitted from the additional illumination module is emitted through the aperture of the "first" light beam collector and a very intense common light beam can in this way be created. It is also possible to provide the additional light beam collector with an aperture whereby a similar illumination module can be adapted to emit light along the optical axis. In this way a large number of illumination modules can be stacked.

FIGS. 3*a* and 3*b* illustrate another embodiment of an illumination device 300 according to the first and second aspect of the present invention. FIG. 3*a* illustrates a perspective front view and FIG. 3*b* is a simplified cross sectional view along line D-D in FIG. 3*a*. The illumination device 300 is similar to the one illustrated in FIG. 2*a*-2*b* and similar elements are labeled with the same reference numbers and will not be described in this section. In this embodiment the illumination device comprises a first illumination module 101 and a second illumination module 301, where the illumination module 101 is similar to the illumination module described in FIG. 1*a*-1*d* and FIG. 2*a*-2*b*. The second illumination module 301 has been arranged at the bottom side of the first illumination module 101 and is adapted to act as an additional light source emitting light through the aperture 123 of the first illumination module 101.

The second illumination module 301 comprises similar to the first illumination module a number of additional light sources 339 and number of additional light collectors 341, where each additional light collector 341 is adapted to collect light from at least one of the additional light sources 339 and is adapted to convert the collected light into an additional source light beam (306 illustrated in dashed lines in FIG. 3*b*). It is to be understood that in alternative embodiments the additional light collectors may be adapted to collect light form more than one additional light source, for instance in the case where the additional light sources are multicolor LEDs with a number of LED dies emitting different color. It is also noted that the additional light sources and/or additional light collectors may be different for instance in the case that different types (e.g. have different color or color temperature) are used. Further the additional light collectors may be omitted or integrated as a part of the light sources.

The additional light sources 339 and additional light collectors 341 are arranged offset the optical axis 107 (dashed-dotted-dotted line), meaning that the additional light sources and additional light collectors are positioned a distance from the optical axis 107. In the illustrated embodiment the additional light sources 339 are mounted on a PCT 343 arranged on the bottom part of the light collector 113 of the first illuminating module 101 and form a ring around the optical axis 107. The second illumination module 301 can comprise a light source module similar to the light source module 109 of the first illumination module 101, which would result in the fact that the first and second illumination modules can be provided as separate models which can be combined. The second illumination module comprises a number of holes 308 in perimeter thereof for fastened it to the first illumination device together using a number of screws (not shown), howler other kind of fastening means like glue, snap mechanisms, magnets etc. can be used.

The illustrated additional light collectors 341 are embodied as a number of TIR lenses having a central and a peripheral part as known in the art of TIR lenses, however is it to be understood that the light collectors may be embodied as any optical component capable of collecting light form the light source and convert the collected light into a light beam, such as optical lenses, light rods/mixers, reflectors etc. Further the additional light sources may generate the source light beams directly and the additional light collectors may in such embodiments be omitted or integrated as a part of the additional light sources.

The second illumination module comprises a additional light beam collector 349 adapted to combine the additional source light beams 306 generated by the additional light sources 339 and additional light collectors into an additional common light beam propagating along and at the optical axis in the positive direction. The additional light beam collector comprises a first additional reflector 351 surrounding the optical axis and a second additional reflector 351 surrounding the optical axis. The first additional reflector 351 reflects the additional sources light beams 306 propagating offset the optical axis towards the second additional reflector 353 and thereafter the second additional reflector reflects the additional source light beams hitting the second additional reflector in the positive direction along the optical axis. The additional light beam collector 349 is like the light beam collector 113 divided into a number of additional reflector pairs, where each additional reflector pair comprises a first additional surface part of the first additional reflector and a second additional surface part of the second additional reflector 117. The first additional reflector 351 of the additional light beam collector 349 is thus divided into a number of first additional surface parts and the second additional surface parts 353 of the additional light beam collector 349 is thus divided into a corresponding number of second additional surface parts. Each of the first and second additional surface parts have been combined into an additional reflector pair. Each reflector pair of the second illumination module 349 can be adapted to provide a homogenize beam at the optical gate and at the same time provide light beams within the acceptance angle of the projecting system whereby more light will by projected along the optical axis. It is noticed that in some embodiments the gobo wheel can be omitted whereby a non-imaging light beam can be created. The reflector pairs of the second illumination module can be designed in a similar way as described in connector with the first illumination module.

The skilled person realize that the first and second surface part of the reflector pairs of the light collector 113 and the additional light collector properly are different as there is a larger optical distance from the additional light sources of the second illumination module to the projecting system. Further it is possible to provide further illumination modules which are adapted to emit light through apertures in the central part of the illumination modules arrange there above.

The light collectors can be for instance manufactured as a piece of molded or grinded metal polished or coated with a reflective coating. The light collector also can be manufactured in ceramic, glass or polymers also coated with reflective coatings.

Additionally the light collectors can be provided as a transparent solid body where the light beams enter the solid body through an entrance surface and are transmitted to the first reflective surface parts which constitutes an internal side of the solid body. The light beams are hereafter reflected towards the second reflective surface parts which also constitute an internal side of the solid body, thereafter the light beams are reflect towards an exit surface of the solid body. The first and second reflective surfaces of the solid body can for instance be covered by a reflective material at the outer side or provide with a surface treatment improving the internal reflective properties of the first and second reflective surfaces parts. It is also possible to design the transparent solid body and reflective surface parts such that the light beams will be reflected at the first and second reflection surface parts due to total internal reflection as known in the art of optics. The solid body can for instance be molded or grinded in glass ceramics or polymers. The light collectors colleting light form the light sources can also be integrated into the solid body.

In one embodiment three illumination modules according to the first aspect of present invention can been stacked above each other with an upper, middle and bottom illumination module. The light collector of the upper and middle illumination models is construed as molded piece of polymer or glass coated with dichroic filters where the upper illumination module comprises red light sources only and the dichroic filter on the upper light collector reflects red light and transmits other wavelengths. The middle illumination module comprises green lights sources only and its corresponding middle light collector comprises a dichroic filter reflecting green light and transmitting blue light, as the bottom illumination module comprises blue light sources. The light form the green light sources will be able to pass through the upper light collector as the surface is transparent to green and blue light. The light form the blue light sources will pass through the upper and middle light collectors. This makes it possible to couple many light beams into a common light beam. The use of dichroic filters makes it possible to avoid the aperture at the bottom of the upper illumination modes as the light from the lower modules still can pass through the upper and middle light collectors which in some situations can result in the fact that more light can be coupled into the common light beam. However it is noticed that, according to the second aspect of the present invention, the apertures still can be provided in the illumination modules in order to allow an additional white light source to couple light into the common light beam. E.g. in order to improve the CRI of the common light beam.

Example of Designing an Illumination Module According the Present Invention

The following describes an example of how an illumination module according to the first aspect of the present invention can be designed. The example serves to illustrate how the illumination module can be designed and is not limiting the scope of the claims, as many other methods can be used to design the illumination device. It is further to be understood that several different illumination modules can be designed by changing the designing conditions e.g. type of light source, choice of light collectors, choice of projecting system, gobo size, physical requirements, desired light output etc.

In this example the illumination module 101 of illumination device of FIG. 2*a*-2*b* has been designed such that as much light as possible will be projected to a target surface whereon the projecting system 225 is adapted to image to gobo plane. At the same time the light distribution at the gobo plane is optimized to have an equal light distribution in all colors. Different combinations of LEDs can be used in such design depending on the application which the illumination device is to be used in. In order to distinguish between different combination, a notation is used which list the number and color of the different types of used LEDs. The combination notation (4R4G4B) describes an illumination device with N=4+4+4=12 LEDs in a combination where four red, four green and four blue LEDs are used. This combination can be used in an application where high output of saturated colors is needed. A (12W) combination with twelve white LEDs can be used when high output of white is needed and (3R3G3B3W) may to some extend be used to accommodate both applications. The different colors of LEDs may be arrange in a symmetric configuration around the optical axis in order to alleviate the reflector design process in creating a rotational symmetric spot and to allow for more uniform color-mixing. This is due to the additive color mixing nature of the LEDs, where only some of the colors may be lit at a given time to generate a specific color.

In this example an illumination device design with N=12 LEDs was chosen as it allows for many different combinations of LED colors to be used and the (4R4G4B) configuration is used in order to allow for high output of saturated colors, which is where LEDs really distinguish from HID sources. The CBT-90 series of LEDs from Luminus Devices were chosen since they deliver high lumen output from a 3×3 mm die and they come in red, green, blue and white versions and can be driven with a current of up to 13.5 A. The LEDs are electrically connected in three different serial chains, one for each color such that the same current flows through LEDs of same color. The current for each chain can be adjusted individually in order to control the color-mixing as known in the art of additive color mixing. Each LED is mounted on a thin galvanic isolating thermal pad since they use common anode housing. The optical gate at the gobo plane comprises a light absorbing annulus with a center hole of diameter Ø48 mm. The imaging system is placed after the optical gate and it is the final optical system before the common light beam is projected towards the target surface.

The objective of the design is to project the gobo-plane onto a target surface and it is to be understood that the gate around the gobos cuts of light that would not be properly projected onto the wall and thus eliminating undesired emission.

The illumination device was designed using ray-tracing software written by the investors, which was used to evaluate and optimize the optical performance of the few parameters using a novel geometry-generating engine. The triangulated geometry is then used as input for a ray-tracing engine in the software in order to find the total output of the fixture. The output of the designed illumination device was then "tested" and verified using the commercial available ray-tracing software, ZEMAX. All simulated results are obtained from ZEMAX.

Figure 4:
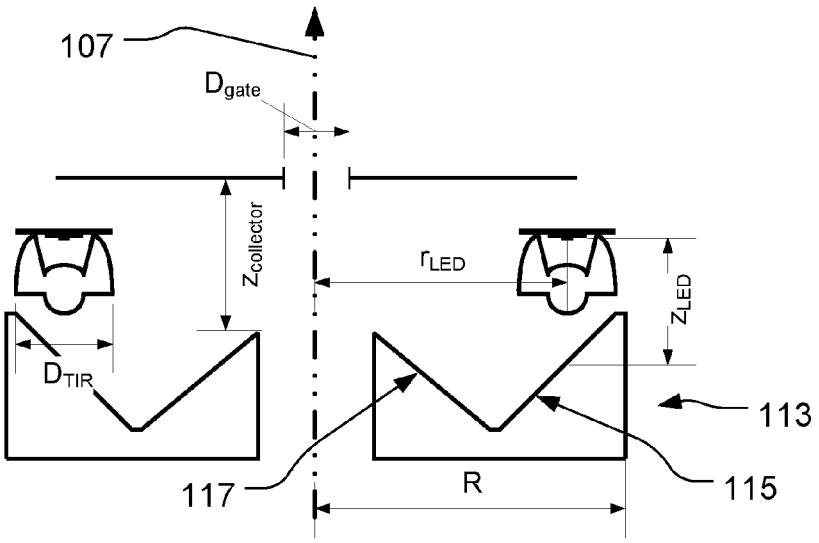
FIG. 4 illustrates simplified illumination device according to the present invention and shows possible design parameters.

FIG. 4 illustrates a simplified drawing of the illumination module and serves to illustrate the variable and fixed design parameters. The illumination device presented in this example is based on N=12 CBT-90 LEDs with attached TIR-lenses. In this example the reflector pairs of the light collector are chosen to be identical, however the skilled person realize that the reflector pairs also may be different. When designing a light collector with N=12 reflector pairs, each pair has a 360/N=30 degree angular sector shaped slice available with a radius R which is restricted to 115 mm in order to inside the a predetermined light fixture (in this example the Exterior 1200 IP™ light fixture further provided by the applicant). The TIR-lenses which are mounted on each LED were designed for the CBT-90 for use in a similar application and were reused here in order to reduce the complexity of the optical system design process. However it is noticed that the design of the TIR lens also may be included as variables in the design process. The TIR-lenses have a diameter $D_{TIR}$ of 32 mm. In order to keep prototyping simple, some pre-existing items have been chosen for the illumination device and kept fixed during this example. The projecting system and gobo wheel have be chosen to be the projecting system from a SmartMAC™ moving head (previous provided by the applicant) and the diameter $D_{gate}$ of the optical gate is thus Ø48 mm. The LEDs and TIR-lens are also kept fixed in this example. There are several sources of optical loss in such illumination device. For instance the TIR-lenses have transmission of 89.4% (measured directly in front of it). Some light is also lost in the projecting system, but this is not a constant as it depends on the angle and position of the rays passing through it. The purpose of the optical gate is to stop light which would otherwise reach the objective in unwanted angles and thus some light is stopped here. The projecting system comprises 7 lenses arranged in movable mounts in order to provide focus and zoom. The lenses comprise different types of glass and are handled in the ray-tracing. In this example the anti-reflective (AR) coating of the lenses is not handled in the ray-tracing and is applied manually to the results afterwards. Each interface in the ray-tracing will generate a higher loss than the actual coating would and the refracted rays will have a lower power. Assuming perfect transmission for all wavelengths for the AR-coating, the loss in the simulations is just the Snell's reflection coefficient for each of the 14 interfaces. A factor of 1.42 is multiplied to the detected values of the rays which have passed through the objective in order to compensate for the introduced loss.

The LED die center for each reflector pair is placed above the first surface part in a distance $z_{LED}$ and at a radius $r_{LED}$ from the optical axis such that the LED emits light in the negative direction of the optical axis 107. Further the light collector is placed a distance $Z_{collector}$ from the gate.

The number N of LEDs is inherently an integer optimization parameter, but is in this example kept fixed at N=12 the sake of simplicity. In general when more LEDs are used, the reflecting area available for each reflector pair decreases and thus potentially reduces the efficiency $\eta$.

Figure 5:
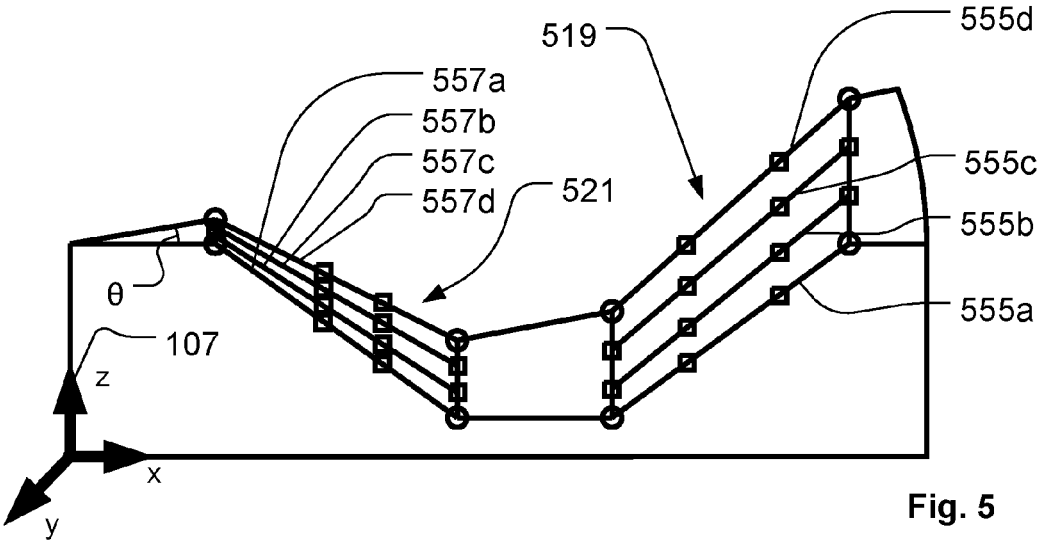
FIG. 5 illustrates a perspective view of a part of a reflector pair used in a designing method.

The shapes of the first and second surface parts of the reflector pair of the light collector are modeled using third-order (quadratic) Non-Uniform Rational B-Spline (NURBS). However the skilled person realize that any order of NURBS can be used. In order to reduce the number of optimization parameters, half of an angular sector shaped reflector pair is modeled. FIG. 5 illustrates perspective view a half an angular sector reflector pair use to model and design the reflector pairs of the light collector and the other half is constructed by mirroring the first half through the y=0 plane.

The first 519 and the second 521 surface parts are modeled using two quadratic Non-Uniform Rational B-Spline (NURBS) with 4×4 points (illustrated as squares and circles where the squares indicate control points and the circles indicate corner points. The corner points are points which the surface touches and the control points are used to guide the surface shape. The 16 points of each NURBS with their assigned weight gives a total of 16×(3+1)=64 parameters for each of the first and second surface parts in a reflector pair. The first 519 and second 521 surface parts illustrated in FIG.

5 becomes after the optimization process surface parts 119*a-l* and 121*a-l* illustrated in FIG. 1*d*.

The points on the first surface 519 part are initially aligned on four rows 555*a-d* and the points on second surface part 117 are initially arranged on four rows 557*a-d*. The points in row 555*a* and 557*a* are bound to the y=0 plane and the points in row 555*d* and 557*d* are bound the edge (θ=15 deg.) plane. This reduces the number of parameters by 8 (one for each point) for each NURBS. In order to make the first and second surfaces continuous at the y=0 plane, the points in rows 555*b* and 557*b* follows respectively the points in rows 555*a* and 557*b* on the x and z axis. This only allows y movement of the points in row rows 555*b* and 5557*b*, thus reducing the problem by 4×2 parameters for each NURBS.

The entire optimization problem is thus based on these variable parameters:

$r_{LED}$;

$z_{LED}$;

$Z_{Collector}$;

(64−8−8)=48 parameters for the NURBS surfaces of the first surface part;

(64−8−8)=48 parameters for the NURBS surfaces which results in a total of 99 parameters for the optimization.

Figure 6:
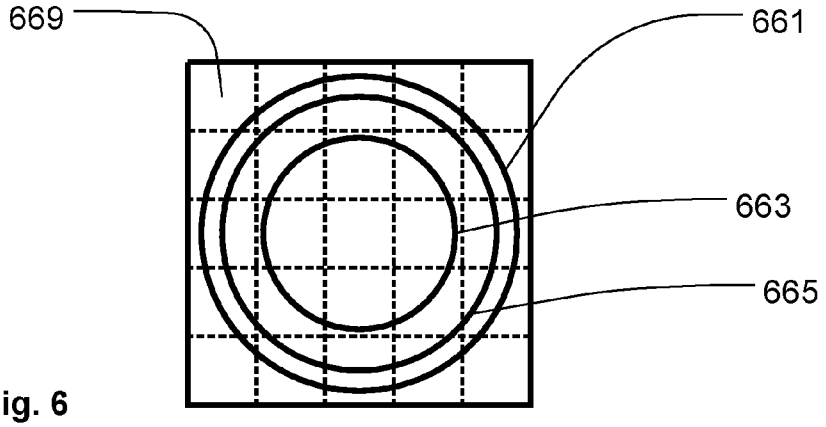
FIG. 6 illustrates a detector used in the a designing method.

Every point in the optimization is constrained to be behind the gate and within the outer bounds of the reflector assembly (R=115 mm). The optimization merit function M consists of two main parts, M1 and M2, which respectively provides high output and uniform color-mixing respectively. The merit function parts are constructed such that a minimization of the merit function parts achieves these goals. The principle behind the color-mixing part of the merit function is illustrated in FIG. 6 where a square detector plane is depicted. The detector used in the ray-tracing simulations is placed 10 m after the projecting system and comprises of 101×101 pixels 659 (only 5×5 are depicted for simplicity), each detecting the total intensity and tristimilus color values (X,Y,Z) of the incident rays. In order to determine the color-mixing of the beam, the spot radius (r=1) 661 is found and the two domains $\Omega_1$ 663 and $\Omega_2$ 665 are established and the pixels in these domains are used for the color mixing part of the merit function in Eq. 2.

In order to determine the fixture output and color uniformity, all LEDs in the final system need to be ray-traced in the chosen (4R4G4B) configuration, instead of just modeling a single reflector pair.

The high output part of the merit function is measured using $$M_1=1-\Sigma_i^N F_i/F_0=1-\eta \tag{1}$$

where $F_i$ is the luminous flux hitting pixel i on the detector and $F_0$ is the average flux emitted by the LEDs in the configuration. When $M_1=0$, all of the rays emitted by the LEDs is reaching the detector. The final spot is divided into a center circle domain $\Omega_1$ 663 with r<=0.6 and a surrounding ring domain $\Omega_2$ 665 with 0.6<r<=0.92, where r is the relative radius to that of the spot. The spot radius is found using a cross section profile of the spot and determining the length of the connected pixels which have a value greater than 5% of the maximal cross section value. The edge of the spot is removed from the calculations in order to remove the inherent noise in this region resulting from the finite number of rays in a simulation. The root-mean-square of the distance from the pixel tristimulus coordinate to the mean tristimilus coordinate is calculated for the pixels which are inside each domains using:

$$M_{2,k}=\sqrt{\frac{1}{N_k}\sum_{j\in\Omega_k}^{N_k}|(X_j,Y_j,Z_j)-\langle(X,Y,Z)\in\Omega_k\rangle|^2} \tag{2}$$

where k refers to the domain number and < . . . > is the mean value of the values in domain k. The color merit function is to be minimized and a value of zero corresponds to a completely uniform color in each domain. The center domain has a lower weight as this will naturally have a lower color difference RMS when optimizing for high light output since it is closer to the symmetry axis of the system.

The total merit function to be minimized is:

$$M=AM_1+B(a_1M_{2;1}+a_2M_{2;2}) \tag{3}$$

where A and B are factors to weigh the output and the color-mixing part respectively and $a_k$ are the weighing factors of each domain which is set to $a_1=0.3$ for the center and $a_2=1$ for the ring. The optimization starts with B=0 and increases as the optimization progresses.

The illumination device optimized using a graduated optimization process where a minimum of variables are free initially in order to represent the simplest modification of the model and as the optimization progresses and the solution converges, the number of variables can be increased to allow for a more complex reflector surface. This graduated optimization approach method is used to increase convergence speed. The optimum of a simpler model is used as a starting guess for a more complex model and the process is repeated.

Many of the NURBS parameters are interdependent when creating simple shapes. For instance, specific positions of the 16 points for each NURBS can model a planar surface. The same planar surface can be modeled using 3 corner points while binding the remaining points to be located on this plane. This effectively reduces the number of free variables for this simple first-order approximation to just 9 parameters.

The setup of the LED, optical gate and light collector was simulated in the commercial available retracing program Zemax in order to "test" the optimized setup. The Zemax setup corresponds to the illumination device illustrated in FIG. 2*a*-2*b* with no gobo positioned at the optical gate and with a detector having 101×101 pixels positioned 10 m from the projecting system.

The simulated transmitted light at different positions of the illumination device can be seen in table 1 below. Ray-files for each of the relevant LED color have been used in order to investigate the different wavelength spectra and emission profiles. The output measured by the wall detector has been multiplied with a factor of 1.42 in order to compensate for the missing AR coating of the objective in the simulations. The mirror surface of the reflector is assumed perfect in the simulations. The values in parenthesis are obtained with an aluminum mirror surface and the simulated expected output of the illumination device is that of the wall detector with an aluminum coating on the light collector.

TABLE 1

| | Ray-file | | | |
|---|---|---|---|---|
| Detector | Red | Green | Blue | White |
| At output of TIR lens | 87.52 | 86.88 | 87.24 | 86.94 |
| At optical Gate | 85.23 | 84.06 | 84.25 | 84.29 |
| | 76.12) | (75.13) | (75.39) | (75.31) |

TABLE 1-continued

| Detector | Ray-file Red | Green | Blue | White |
|---|---|---|---|---|
| At target surface/wall | 57.77 (51.13) | 56.59 (50.10) | 56.09 (49.69) | 56.65 (50.16) |

Table 1: The simulated percentage of the light emitted from a CBT-90 LED, reaching different positions in the illumination device, as measure by detectors placed at the locations in the left column. The values in parenthesis are obtained by replacing the perfect mirror coating of the reflector with an aluminum surface.

The corresponding loss of each individual step has been calculated and is listed in Table 2. The expected total efficiency of a reflector with a 4R4G4B configuration can be calculated by using the values of table 1 to be 0.503 for an AR factor of 1.42 by taking the average efficiency of the LEDs used.

TABLE 2

| Detector | Ray-file Red | Green | Blue | White |
|---|---|---|---|---|
| LED to TIR LENS | 12.48 | 13.12 | 12.76 | 13.06 |
| TIR LENS to optical gate | 2.62 (12.76) | 3.25 (13.25) | 3.42 (13.35) | 3.06 (13.13) |
| Optical gate to reflector | 32.22 | 32.68 | 33.43 | 32.79 |

Table 2: The simulated percentage of the light emitted from a CBT-90 LED, reaching different positions in the illumination device, as measure by detectors placed at the locations in the left column. The values in parenthesis are obtained by replacing the perfect mirror coating of the reflector with an aluminum surface.

Figure 7A:
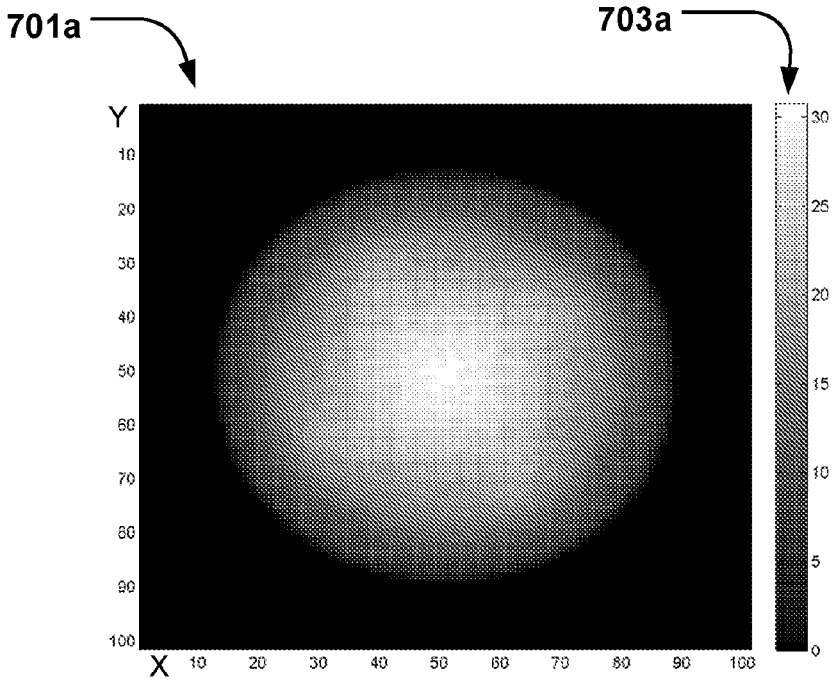
FIG. 7*a*-7*d* illustrates cross sectional intensity plot of the common light beam generated by an illumination device according to the present invention.
Figure 7B:
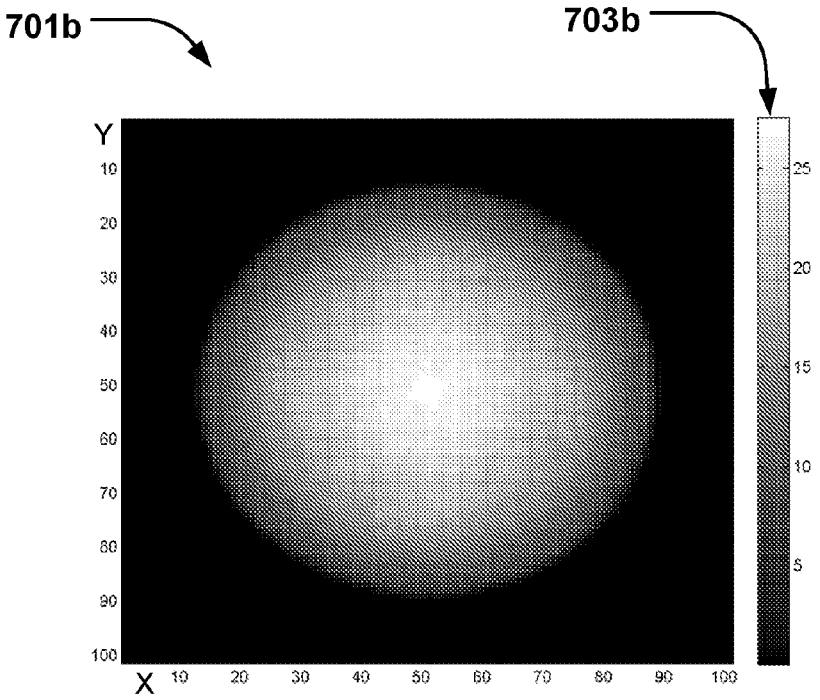
Figure 7C:
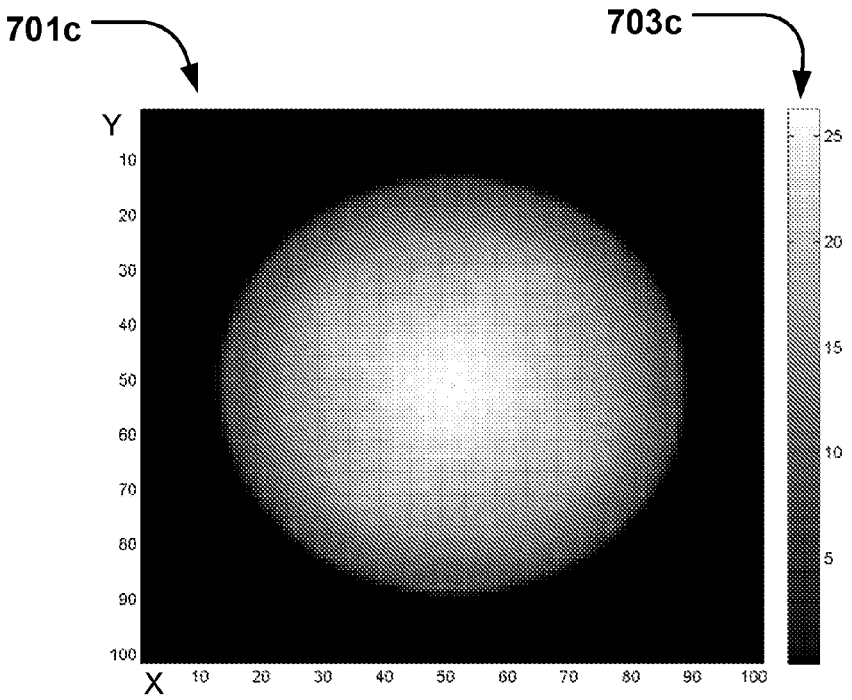
Figure 7D:
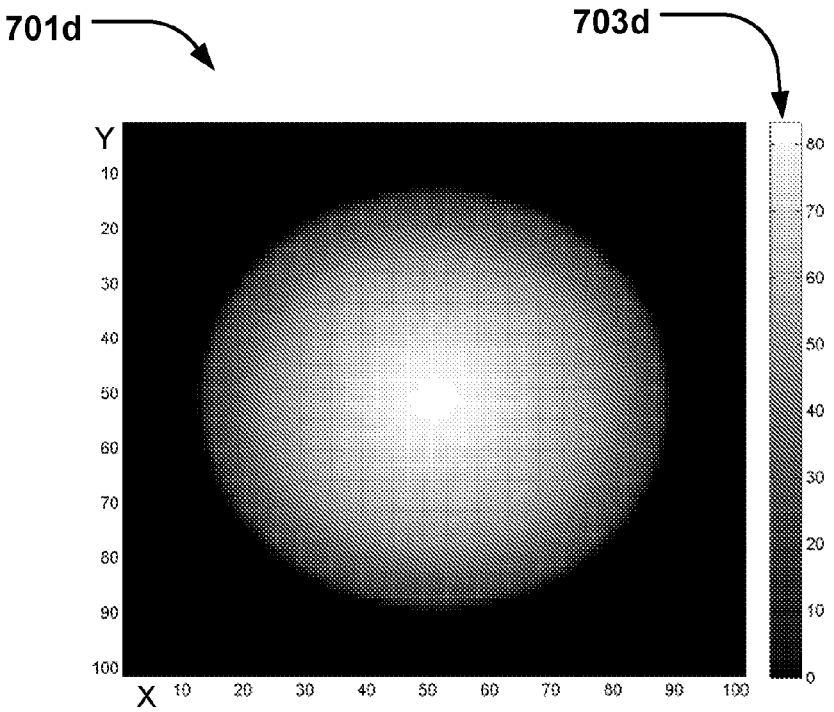

FIG. 7*a*-7*d* illustrates cross sectional intensity plot 701*a*-*b* of the common light beam simulated in Zemax. The Zemax setup corresponds to the illumination device illustrated in FIG. 2*a*-2*b* with no gobo positioned at the optical gate and with a detector positioned 10 m from the projecting system. FIG. 7*a* is measured with only the red light sources activated, FIG. 7*b* is measured with only the green light sources activated, FIG. 7*c* is measured with only the blue light sources activated and FIG. 7*b* is measured with all (red, green and blue) light sources activated.

The pixels of the Zemax detector are illustrated at the X and Y axis of the plots, and the grayscale 703*a*-*d* at the right side of the intensity plots indicated the intensity level in lumen pr. pixel. The intensity plots illustrate that the intensity of the different colors are substantially distributed across the gate and as a consequence color artifacts are reduced.

A prototype of the light collector was fabricated after data of the optimum solution found by the optimization procedure. The light collector was made using a CNC-machined aluminum block which was subsequent chrome-plated using electro-deposition in order to provide a smooth surface. A 40 nm layer of aluminum was then deposited onto the chrome in order to reduce reflection loss. The light source module was constructed as a hollow aluminum block acting with in and out let for cooling fluid like water. The LEDs and TIR-lenses were mounted the aluminum block and de cooling fluid provides sufficient cooling for the LEDs. This system integrated into an illumination device comprising the projecting system. In order to measure the actual output of the device, a Ø1 m target was placed in a distance of 2.5 m in front of the gate. The target is a paper target with a Ø1 m circle with 31 measurement points drawn inside. The measurement points are arranged as a center point with 5 rings surrounding it, each having 6 points each. The spot is focused on the target such that all light is just inside the 1 m target and the luminance (lumen/$m^2$) is measured at each point using a Thoma TF5 tristimilus color meter. The average luminance of each ring is multiplied by the area and these values are then added to give the total lumen output. This value is then compared to the factory-measured output off the LEDs and compensated for the running conditions (temperature and drive current) in order to calculate the final efficiency $\eta$.

The prototype was build and the output was measure using the described method. A total output of 6038 lm was measured with all the LEDs drawing 13.5 A and with a heat sink temperature of 65 degrees Celsius as measured by an on-board thermistor. Comparing to the factory measured values for each LED and compensating for lower output due to the temperature, the measured efficiency is 48.7%.

The invention claimed is:

1. An illumination device, comprising:

a plurality of light sources distributed offset and around an optical axis, wherein said plurality of light sources generates a plurality of source light beams; and a light beam collector adapted to combine said source light beams into a common light beam propagating along said optical axis, said light beam collector comprising:

a first reflector surrounding said optical axis, and a second reflector surrounding said optical axis, wherein said first reflector reflects said sources light beams towards said second reflector, and said second reflector reflects said source light beams in a direction along said optical axis;

wherein said light beam collector is divided into a plurality of reflector pairs, wherein each reflector pair in the plurality of reflector pairs comprises:

a first surface part of said first reflector, and a second surface part of said second reflector, wherein each reflector pair in the plurality of reflector pairs is formed as an angular sector, said first surface part is formed at the outer part of said angular sector, and said second surface part is formed at the inner part of said angular sector, wherein said second surface part receives light from the corresponding first surface part of said reflector pair, and wherein said reflector pairs are adapted to couple said light source beams into an optical gate, said optical gate being arranged along said optical axis.

2. The illumination device according to claim 1, wherein said first surface part is adapted to adjust the shape of said source light beam such that most of said source light beam hits the second surface part and in that the second surface part is adapted to modify the shape of the received source light beam into the shape of an optical gate arranged along said optical axis.

3. The illumination device according to claim 1, wherein at least one of said first surface part or said second surface part comprises both a convex surface part and a concave surface part.

4. The illumination device according to claim 1, wherein the mutual size relationship between the different reflector pairs are substantially identical to at least one of:

a mutual relationship between emitting characteristics of said light sources;

a mutual size relationship between said light sources;

a mutual relationship between emitting characteristics of said source light beams; and a mutual size relationship between said source light beams.

5. The illumination device according to claim 1, wherein the mutual size relationship between the different reflector pair have been determined in order to achieve at least one of:

maximum light output at said optical gate;

maximum light output at a target surface whereon an optical projecting system is adapted to image said optical gate;

a predefined spatial spectra distribution at said optical gate; and a predefined spatial spectra distribution a target surface whereon an optical projecting system is adapted to image said optical gate.

6. The illumination device according claim 1, wherein said light beam collector comprises an aperture and that said reflector pairs are positioned around said aperture.

7. The illumination device according to claim 6, wherein at least a portion of said first reflector and/or said second reflector is embodied as a dichroic filter adapted to reflect light from at least one of said light sources and to transmit light having a different wavelength than said light of said light source.

8. The illumination device according to claim 7, comprising an additional light source adapted to emit light along said optical axis and through at least one of:

said aperture of said light beam collector; and said dichroic filter.

9. The illumination device according to claim 8, wherein said additional light source being an illumination module, wherein said illumination module comprises:

a plurality of additional light sources distributed offset and around said optical axis, wherein said plurality of light sources generates a plurality of additional source light beams; and an additional light beam collector adapted to combine said additional source light beams into an additional common light beam propagating along said optical axis, said additional light beam collector comprising:

a first additional reflector surrounding said optical axis, and a second additional reflector surrounding said optical axis, wherein said first additional reflector reflects said additional sources light beams towards said second additional reflector, said second additional reflector reflects said additional source light beams in a direction along said optical axis, and said additional light beam collector is divided into a plurality of additional reflector pairs, wherein each additional reflector pair of the plurality of additional reflector pairs comprises:

a first additional surface part of said first additional reflector, and a second additional surface part of said second additional reflector, wherein said second additional surface part receives light from the corresponding first additional surface part of said additional reflector pair.

10. A light beam collector adapted to combine a plurality of source light beams generated by a plurality of light sources into a common light beam propagating along an optical axis, said light beam collector comprising:

a first reflector surrounding said optical axis; and a second reflector surrounding said optical axis;

wherein said first reflector reflects said sources light beams towards said second reflector, said second reflector reflects said source light beams in a direction along said optical axis;

wherein said light beam collector is divided into a plurality of reflector pairs, and each reflector pair in the plurality of reflector pairs comprises:

a first surface part of said first reflector, and a second surface part of said second reflector, wherein each reflector pair in the plurality of reflector pairs is formed as an angular sector, said first surface part is formed at the outer part of said angular sector, and said second surface part is formed at the inner part of said angular sector, wherein said second surface part receives light from the corresponding first surface part of said reflector pair and wherein said reflector pairs are adapted to couple said light beams into an optical gate, said optical gate being arranged along said optical axis.

11. The illumination device according to claim 10, wherein said first surface part is adapted to adjust the shape of said source light beam such that most of said source light beam hits the second surface part and in that the second surface part is adapted to modify the shape of the received source light beam into the shape of an optical gate arranged along said optical axis.

12. The light beam collector according to claim 10, wherein each reflector pair in the plurality of reflector pairs is adapted to image said light sources at a distance along said optical axis and to distort said image of said light sources at said distance.

13. The light beam collector according to claim 10, wherein at least one of said first surface part and said second surface part comprises both a convex surface part and a concave surface part.

14. The light beam collector according claim 10, wherein said light beam collector comprises an aperture, and said reflector pairs are positioned around said aperture.

15. An illumination device, comprising:

a plurality of light sources distributed offset and around an optical axis, said plurality of light sources generating a plurality of source light beams; and a light beam collector adapted to combine said source light beams into a common light beam propagating along said optical axis, said light beam collector comprising:

a first reflector surrounding said optical axis, and a second reflector surrounding said optical axis, wherein said first reflector reflects said sources light beams towards said second reflector, and said second reflector reflects said source light beams in a direction along said optical axis and through an optical gate, said optical gate being arranged along said optical axis;

wherein said light beam collector is divided into a plurality of reflector pairs, each reflector pair comprising:

a first surface part of said first reflector, and a second surface part of said second reflector, wherein each reflector pair in the plurality of reflector pairs is formed as an angular sector, said first surface part is formed at the outer part of said angular sector, and said second surface part is formed at the inner part of said angular sector, wherein said light beam collector comprises an aperture, and that said first reflector and said second reflector are positioned around said aperture.

16. The illumination device according to claim 15, wherein said illumination device comprises an additional light source adapted to emit light along said optical axis and through at least one of said aperture of said light beam collector.

17. The illumination device according to claim 16, wherein at least one of said light sources comprises a broad spectrum light source emitting a broad spectrum of light and in that at least another one of said light sources comprises a narrow spectrum light source emitting a narrow spectrum of light.

18. The illumination device according to claim 17, wherein said at least one light narrow spectrum light source emits light substantially within at least one of the following wavelength intervals:

[380 nm,450 nm];
[450 nm,495 nm];
[495 nm,570 nm];
[570 nm,590 nm];
[590 nm,620 nm]; and
[620 nm,750 nm];

and wherein said broad spectrum light source emits light within at least two of the following wavelength intervals:

[380 nm,450 nm];
[450 nm,495 nm];
[495 nm,570 nm];
[570 nm,590 nm];
[590 nm,620 nm]; and
[620 nm,750 nm].

19. The illumination device according to claim 17, wherein said illumination device further comprises:

at least one narrow spectrum light source emitting light in the wavelength interval of [450 nm,495 nm];

at least one narrow spectrum light source emitting light in the wavelength interval of [495 nm,570 nm]; and at least one narrow spectrum light source emitting light in the wavelength interval of [620 nm,750 nm];

wherein said broad spectrum light source emits light outside the following wavelength intervals:

[450 nm,495 nm];
[495 nm,570 nm]; and
[620 nm,750 nm].

20. The illumination device according to claim 17, wherein said additional light source comprises said broad spectrum light source.

21. The illumination device according to claim 16, wherein said additional light source being an illumination module comprises:

a plurality of additional light sources distributed offset and around said optical axis, wherein said plurality of additional light sources generates a plurality of additional source light beams; and an additional light beam collector adapted to combine said additional source light beams into a common light beam propagating along said optical axis, said additional light beam collector comprising:

a first additional reflector surrounding said optical axis, and a second additional reflector surrounding said optical axis, wherein said first additional reflector reflects said additional sources light beams towards said second additional reflector, and said second additional reflector reflects said additional source light beams in a direction along said optical axis.

* * * * *